US005782184A

United States Patent [19]

Albertalli et al.

[11] Patent Number: 5,782,184

[45] Date of Patent: Jul. 21, 1998

[54] PRINTER HEAD CARRIAGE AND METHOD FOR ALIGNING PRINTER HEADS ON A PRINTER HEAD CARRIAGE

[75] Inventors: David Albertalli; Paul Gregory; Larry Capps, all of San Jose; Noel Schmidt, Palo Alto, all of Calif.

[73] Assignee: Raster Graphics, Incorporated, San Jose, Calif.

[21] Appl. No.: 815,590

[22] Filed: Mar. 12, 1997

[51] Int. Cl.[6] ..... B41J 1/37

[52] U.S. Cl. ..... 101/486; 400/120.02; 400/120.16; 347/12; 347/40

[58] Field of Search ..... 400/120.16, 120.02; 101/486, DIG. 36; 347/12, 13, 40, 41, 42, 108, 222, 245, 263

[56] References Cited

U.S. PATENT DOCUMENTS

| | | | |
|---|---|---|---|
| 3,584,571 | 6/1971 | Schmoll | 347/12 |
| 4,025,925 | 5/1977 | Jensen et al. | 347/40 |
| 4,368,477 | 1/1983 | Heinzl et al. | 347/40 |
| 4,559,544 | 12/1985 | Matsumoto et al. | 347/40 |
| 4,791,440 | 12/1988 | Eldridge et al. | 347/40 |
| 5,157,420 | 10/1992 | Naka et al. | 347/40 |
| 5,185,615 | 2/1993 | Koitabashi et al. | 347/12 |
| 5,241,325 | 8/1993 | Nguyen | 347/40 |
| 5,486,057 | 1/1996 | Suinner et al. | 400/120.02 |
| 5,488,397 | 1/1996 | Nguyen et al. | 347/40 |
| 5,492,421 | 2/1996 | Fushimi et al. | 400/120.02 |
| 5,629,771 | 5/1997 | Mikami | 347/40 |

*Primary Examiner*—Eugene H. Eickholt

*Attorney, Agent, or Firm*—Burns, Doane, Swecker & Mathis, LLP

[57] ABSTRACT

Printer heads are precision mounted relative to a plate on a printer carriage by assembling a plurality of identical printer head assemblies, each of the printer head assemblies including a printer head precision mounted to a printer head carrier, each of the printer head carriers having at least three alignment points. Openings are provided in a plate in precise locations corresponding to desired locations and orientations of the printer head assemblies on the plate. The openings each have at least three alignment points corresponding to the three alignment points on each of the printer head carriers. The printer head assemblies are positioned in corresponding ones of the openings and a force is applied against the printer head assemblies, such as by springs mounted on the plate, to cause the at least three alignment points on the printer head carriers to contact respective ones of the at least three alignment points in the corresponding ones of the openings. A printer head carriage having printer heads precision mounted to a plate is also disclosed.

21 Claims, 7 Drawing Sheets

PRINTER HEAD CARRIAGE AND METHOD FOR ALIGNING PRINTER HEADS ON A PRINTER HEAD CARRIAGE

BACKGROUND OF THE INVENTION

1. Field of the Invention

The present invention relates to a printer head carriage and, more particularly, to a printer head carriage having a plurality of precisely aligned printer heads mounted thereon, and to a method for precisely aligning printer heads on a printer head carriage.

2. Background and Summary of the Invention

Well known desk top-type ink jet printing apparatus perform a printing operation on a single sheet of, for example, 8½"×11" paper. A printer carriage carrying one or more printer heads is moved laterally across the sheet of paper left-to-right and right-to-left and, on one of the lateral movements, an ink jet is laid down on the paper. The paper advances incrementally after each back and forth movement of the carriage and another ink jet is laid down. In color printing, usually between four and six different colors are laid down over an area by successive heads in successive sweeps across the paper. In such apparatus, because of the small size of the paper, the speed of the operation is not generally crucial.

The present invention is particularly well-suited for use with substantially more sophisticated ink jet printers than desk top models, although it is not limited to use with such printers. With these ink jet printers, it is desirable to produce extremely high quality images, on wide webs of paper, and at very fast printing rates. The requirements of these apparatus in terms of accuracy of paper feed, methods of paper feed, and print head to paper distance are much higher than in conventional ink jet printers and pose problems not encountered in conventional printers.

In ink jet printers of the type with which the present invention is primarily concerned, a printer head typically has numerous small nozzles for spraying very fine ink sprays at specific times. Multiple print head arrangements, each corresponding to a different color, such as the common cyan, magenta, yellow, and black, and each comprising multiple print heads for those colors, are precision mounted relative to one another on an alignment plate such that a unit area is printed in the desired colors numerous times by the numerous print heads, thereby enhancing the quality of the image created. The print head arrangements are preferably mounted on a movable carriage that moves laterally back and forth, i.e., left and right, across the web onto which the ink is to be printed, and the print heads preferably print both when the carriage is moving to the left and when the carriage is moving to the right.

Alignment requirements for printer heads relative to one another, and relative to a workpiece or web being printed, are very high in such apparatus because. Each of the numerous nozzles on each printer head must lay down a drop of ink in a precise location on the web. Moreover, the nozzles on the each of the printer heads must lay down ink drops in precise locations relative to the drops laid down by the other printer heads.

It is desirable that the printer heads be simple to replace so that persons having relatively low levels of skill can replace the printer heads when their nozzles become blocked or the printer heads are otherwise damaged. A simple replacement technique must, however, ensure that the replaced printer heads will be properly aligned on the printer head carriage.

The present invention, generally speaking, provides a printer head carriage carrying multiple, precisely aligned printer heads and a method for precisely aligning printer heads on a printer head carriage. The method of aligning printer heads is simple to perform by persons having relatively low skill levels.

In accordance with one aspect of the present invention, a method for mounting printer heads relative to a plate is disclosed. According to the method, a plurality of identical printer head assemblies are assembled, each of the printer head assemblies including a printer head, the printer head including an array of a plurality of nozzles, and a printer head carrier, each of the printer head carriers having at least three alignment points. Openings are provided in a plate corresponding to desired locations and orientations of the printer head assemblies on the plate, the openings each having at least three alignment points corresponding to the three alignment points on each of the printer head carriers. The printer head assemblies are positioned in corresponding ones of the openings. A force is applied against the printer head assemblies to cause the at least three alignment points on the printer head carriers to contact respective ones of the at least three alignment points in the corresponding ones of the openings.

In accordance with another aspect of the present invention, a mounting arrangement for a plurality of discrete printer heads on a plate is disclosed. The mounting arrangement includes a plurality of identical printer head assemblies, each of the printer head assemblies including a printer head, the printer head including an array of a plurality of nozzles, and a printer head carrier, each of the printer head carriers having at least three alignment points. The mounting arrangement includes a plate having a plurality of openings corresponding to desired locations and orientations of the printer head assemblies, the openings each having at least three alignment points corresponding to the three alignment points on each of the printer head carriers. The mounting arrangement also includes a plurality of force applying arrangements, each force applying arrangement of the plurality of force applying arrangements being mounted on the plate relative to a corresponding opening of the plurality of openings and applying a force against a corresponding printer head assembly of the plurality of printer head assemblies disposed in the corresponding opening to cause the at least three alignment points on the printer head carrier of the printer head assembly to contact respective ones of the least three alignment points in the opening.

In accordance with yet another aspect of the invention, a method for mounting printer heads relative to a plate is disclosed. According to the method, a printer head assembly of a plurality of identical printer head assemblies is provided. Each of the printer head assemblies includes a printer head, the printer head including an array of a plurality of nozzles, and a printer head carrier, each of the printer head carriers having at least three alignment points. The printer head assembly is positioned in one opening of a plurality of openings in a plate corresponding to desired locations and orientations of the printer head assemblies on the plate, the openings each having at least three alignment points corresponding to the three alignment points on each of the printer head carriers. A force is applied against the printer head assemblies to cause the at least three alignment points on the printer head carriers to contact respective ones of the at least three alignment points in the corresponding ones of the openings.

BRIEF DESCRIPTION OF THE DRAWINGS

The features and advantages of the present invention are well understood by reading the following detailed description in conjunction with the drawings in which like numerals indicate similar elements and in which.

DETAILED DESCRIPTION

Figure 1:
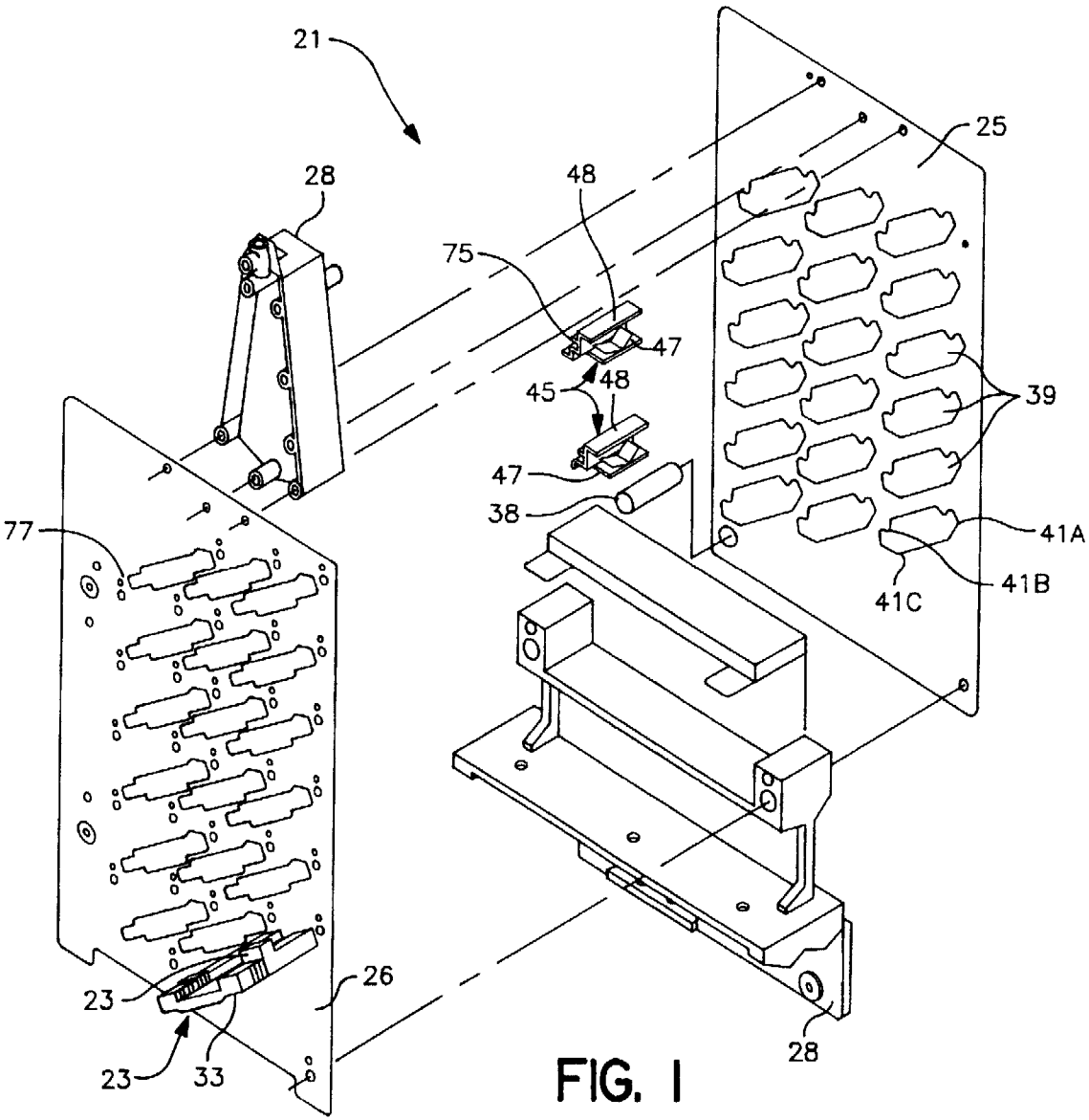
FIG. 1 is an exploded perspective view of a printer head carriage according to an embodiment of the present invention.

A printer head carriage 21 on which a plurality of discrete printer heads 23 are mounted on an alignment plate 25, which is preferably flat, is shown in FIG. 1. The printer head carriage 21 carries a plurality of identical printer head assemblies 27. A rear plate 26 is attached to the plate 25 by components including a bearing assembly 28 that assists the carriage 21 in moving along a track, and by spacer members 30, and, preferably, as discussed further below, by carriers for force applying members.

Figure 2:
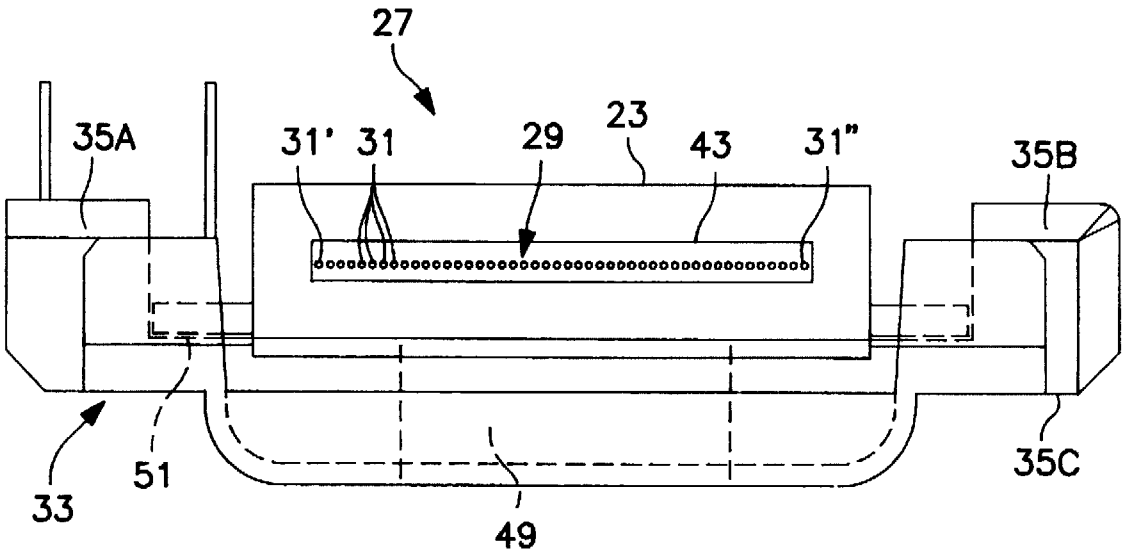
FIG. 2 is a schematic end view of a printer head assembly according to an embodiment of the present invention.

Each of the printer head assemblies 27 includes a printer head 23. A printer head suitable for use in connection with the present invention is manufactured by MIT Inkjet, Stockhohn, Sweden. The printer head 23 preferably includes an array 29 of a plurality of nozzles 31, as seen in FIG. 2.

Figure 5:
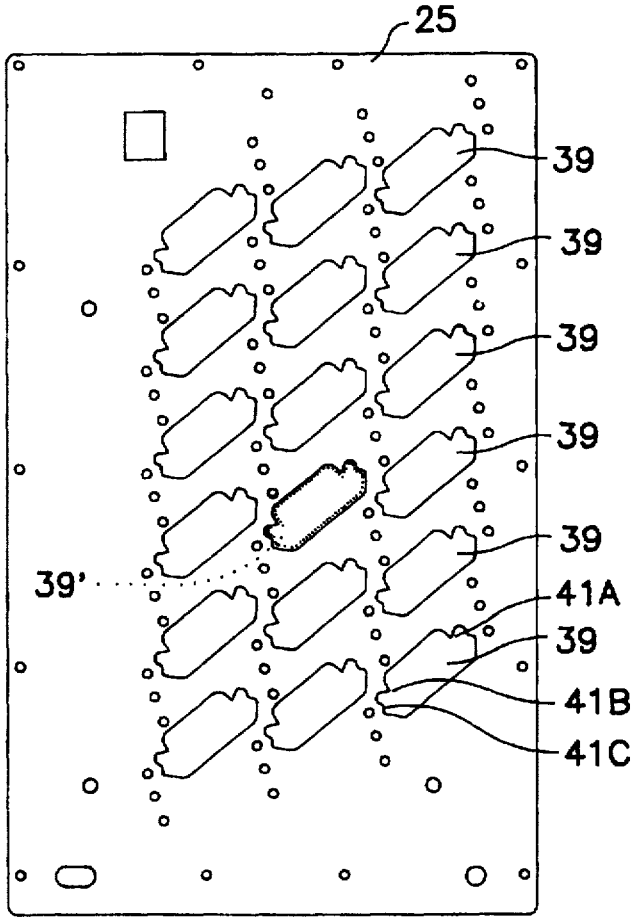
FIG. 5 is a front view of an alignment plate according to an embodiment of the present invention.
Figure 6:
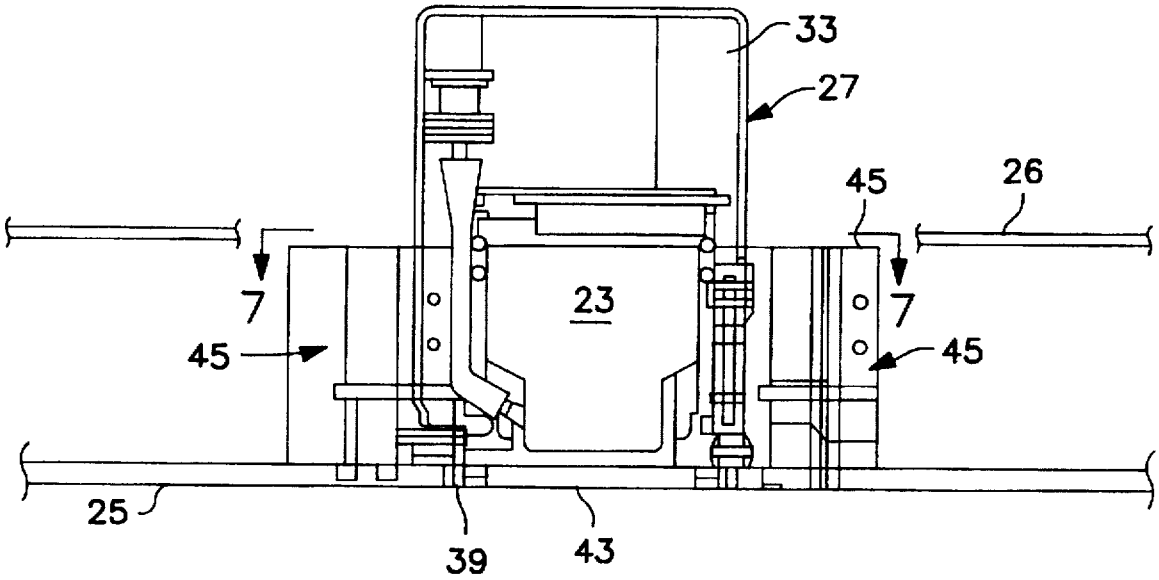
FIG. 6 is a partially broken side view of a portion of a printer head carriage according to an embodiment of the present invention.

As seen in FIGS. 1–4, each printer head assembly 27 also includes a printer head carrier 33. Each of the printer head carriers 33 has at least three alignment points 35A, 35B, and 35C, (FIG. 2) although more alignment points might be provided. As seen in FIGS. 1 and 5, the plate 25 of the printer head carriage 21 has a plurality of openings 39 corresponding to desired locations and orientations of the printer head assemblies 27. The openings 39 each have at least three alignment points 41A, 41B, and 41C corresponding to the three alignment points 35A, 35B, and 35C on each of the printer head carriers 33. As seen in FIG. 6, the printer head assemblies 27 are preferably positioned in the openings 39 such that surfaces 43 of the nozzle arrays 29 are flush with an outside surface of the plate 25 and, thus, lie in a common plane.

Figure 7:
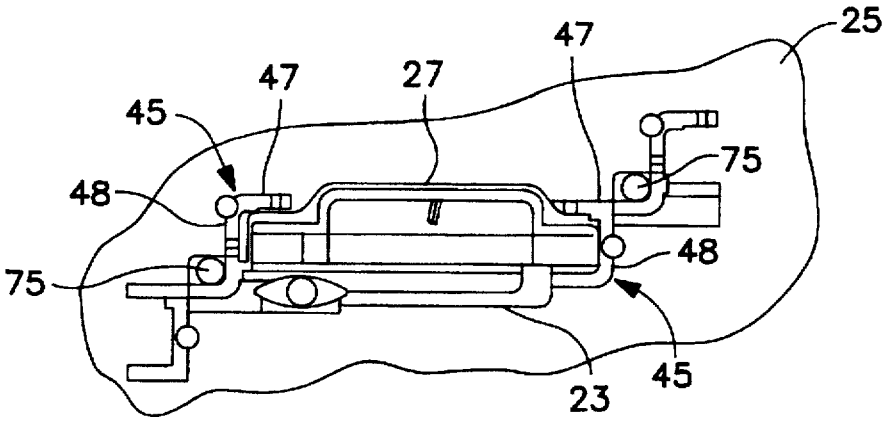
FIG. 7 is a top view of the portion of the printer head carriage shown in FIG. 6 taken along section 7—7 of FIG. 6.
Figure 8:
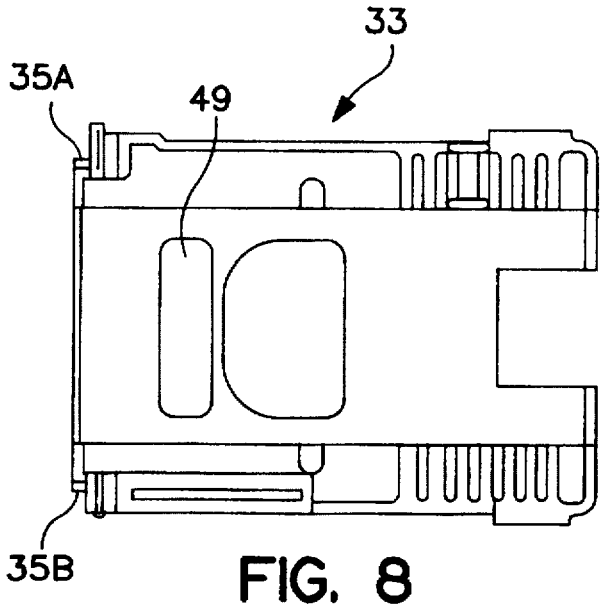
FIG. 8 is a top view of a printer head carrier according to an embodiment of the present invention.

As seen in FIGS. 1, 6, and 7, a plurality of force applying arrangements 45 are provided. Each force applying arrangement 45 is mounted on the plate 25 relative to a corresponding one of the openings 39. A force applying arrangement 45 applies a force against a corresponding printer head assembly 27 disposed in a corresponding opening 39 to cause the at least three alignment points 35A, 35B, and 35C on the printer head carrier 33 of the printer head assembly 27 to contact respective ones of the least three alignment points 41A, 41B, and 41C in the opening 39. The force applying arrangement 45 preferably includes a plurality of springs 47, preferably leaf springs, that contact the printer head assembly 27 to push it so that the alignment points 35A, 35B, and 35C contact respective ones of the alignment points 41A, 41B, and 41C. The springs 47 are preferably mounted on carriers 48 that also operate to maintain the plate 25 and the plate 26 in a desired spaced relationship.

Each printer head 23 is preferably precision mounted to a corresponding printer head carrier 33. Each opening 39 is formed by a precision machining process. Because of the precision mounting of the printer head 23 to the head carrier 33 and the precision machining of the opening 39, installation of the printer head assembly 27 in a precise position on the plate 25 is accomplished without the need for precise positioning of the force applying arrangements 45, particularly where the force applying arrangements include a plurality of compression springs 47, because the compression springs can be more or less compressed and still accomplish the task of contacting the alignment points 35A, 35B, and 35C with the respective ones of the alignment points 41A, 41B, and 41C. Moreover, because of the precision preassembly and opening formation, installation of the printer head assembly 27 in a precise position on the plate 25 is easily accomplished by persons of relatively low skill levels.

As seen in FIGS. 2–4 and 8, each printer head carrier 33 preferably includes an elevated reference surface 49 for assisting in precisely aligning the nozzle array 29 relative to the three alignment points 35A, 35B, and 35C of the printer head carrier. The reference surface 49 of the printer head carrier is preferably a flat surface. A surface 51, preferably flat, of the printer head 23 is secured to the reference surface of the printer head carrier by an adhesive. The adhesive is preferably an adhesive that cures when exposed to ultraviolet light, and the assembly of the printer head assembly 27 is preferably accomplished by a method wherein the adhesive is cured by exposing it to ultraviolet light. The printer head carrier 33 is preferably formed of a material, preferably aluminum, that conducts heat better than the printer head 23 so that the reference surface 49 acts as a heat sink to conduct heat away from the printer head to the atmosphere.

Figure 3:
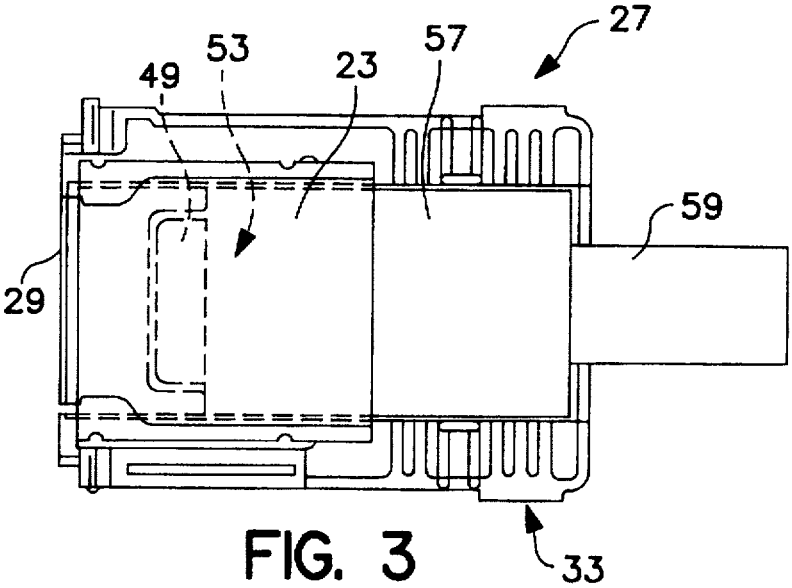
FIG. 3 is a schematic top view of a printer head assembly according to an embodiment of the present invention.
Figure 4:
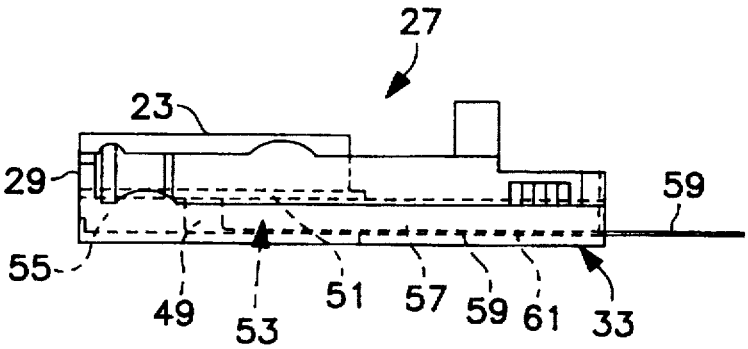
FIG. 4 is a schematic side view of a printer head assembly according to an embodiment of the present invention.

As seen in FIGS. 3 and 4, the printer head assembly 27 preferably also includes an absorbent wick 53 disposed between the printer head carrier 33 and the printer head 23 such that a portion 55 of the wick is disposed proximate the nozzle array 29. The wick 53 assists in absorbing stray drops of ink that, for whatever reason, accumulate by or leak out of the nozzles 31. The absorbent wick 53 preferably includes the portion 55 that is disposed proximate the nozzle array 29 and a second portion 57, the second portion having a greater affinity for liquid than the first portion. The absorbent wick portions 55 and 57 are preferably dimensioned to surround the elevated reference surface 49 on the printer head carrier 33.

The first portion 55 of the absorbent wick 53 is preferably fixed permanently in position between the printer head 23 and the printer head carrier 33 and the second portion 57 is preferably replaceable. Because the second portion 57 has a greater affinity for liquid than the first portion 55, the second portion 57 will tend to absorb liquid from the first portion. An indicator tab 59 is preferably attached to the second portion 57 to indicate that the second portion 57 is saturated with ink so that the second portion can be replaced. The first and second portions 55 and 57 of the absorbent wick 53 are preferably formed of foam rubber. The indicator tab 59 is preferably a clear plastic tab covering an entire surface 61 of and extending beyond an upper end of the second portion 57. When the second portion 57 is saturated with ink, ink accumulates and is visible on the tab 59 where it extends past the upper end of the second portion.

The carriage 21 is preferably used in connection with an ink jet printing apparatus wherein an ink reservoir arrangement provides ink to the printer heads 23. A suitable ink reservoir arrangement is disclosed in commonly-assigned U.S. patent application Ser. No. 08/815,132 (Attorney Docket No. 031228-001), entitled Ink Supply Apparatus, which is incorporated by reference. The carriage 21 is preferably moved relative to an incrementally advanced paper web along a track. A suitable apparatus for incrementally advancing a web is disclosed in commonly-assigned U.S. patent application Ser. No. 08/815,132 (Attorney Docket No. 031228-002), entitled Apparatus and Method for Intermittently Advancing a Web, the disclosure of which is incorporated by reference.

In a method for mounting printer heads 23 relative to an alignment plate 25, a plurality of identical printer head assemblies 27 (FIGS. 2 and 3) are assembled. Each of the printer head assemblies 27 includes a printer head 23, the printer head including an array 29 of a plurality of nozzles 31, and a printer head carrier 33, each of the printer head carriers having at least three alignment points 35A, 35B, and 35C.

Openings 39 (FIGS. 1 and 5) are provided in the plate 25 corresponding to desired locations and orientations of the printer head assemblies 27 on the plate. The openings 39 each have at least three alignment points 41A, 41B, and 41C corresponding to the three alignment points 35A, 35B, and 35C on each of the printer head carriers 33. The printer head assemblies 27 are positioned in corresponding ones of the openings 39. A force is applied against the printer head assemblies 27 by a force applying arrangement 45 such as a spring 47 to cause the at least three alignment points 35A, 35B, and 35C on the printer head carriers 33 to contact respective ones of the at least three alignment points 41A, 41B, and 41C in the corresponding ones of the openings 39.

Each printer head carrier 33 preferably includes an elevated reference surface 49 to which a surface 51 of the printer head 23 is secured by an adhesive. The adhesive is preferably an a type of adhesive that cures quickly when exposed to ultraviolet light.

Figure 9:
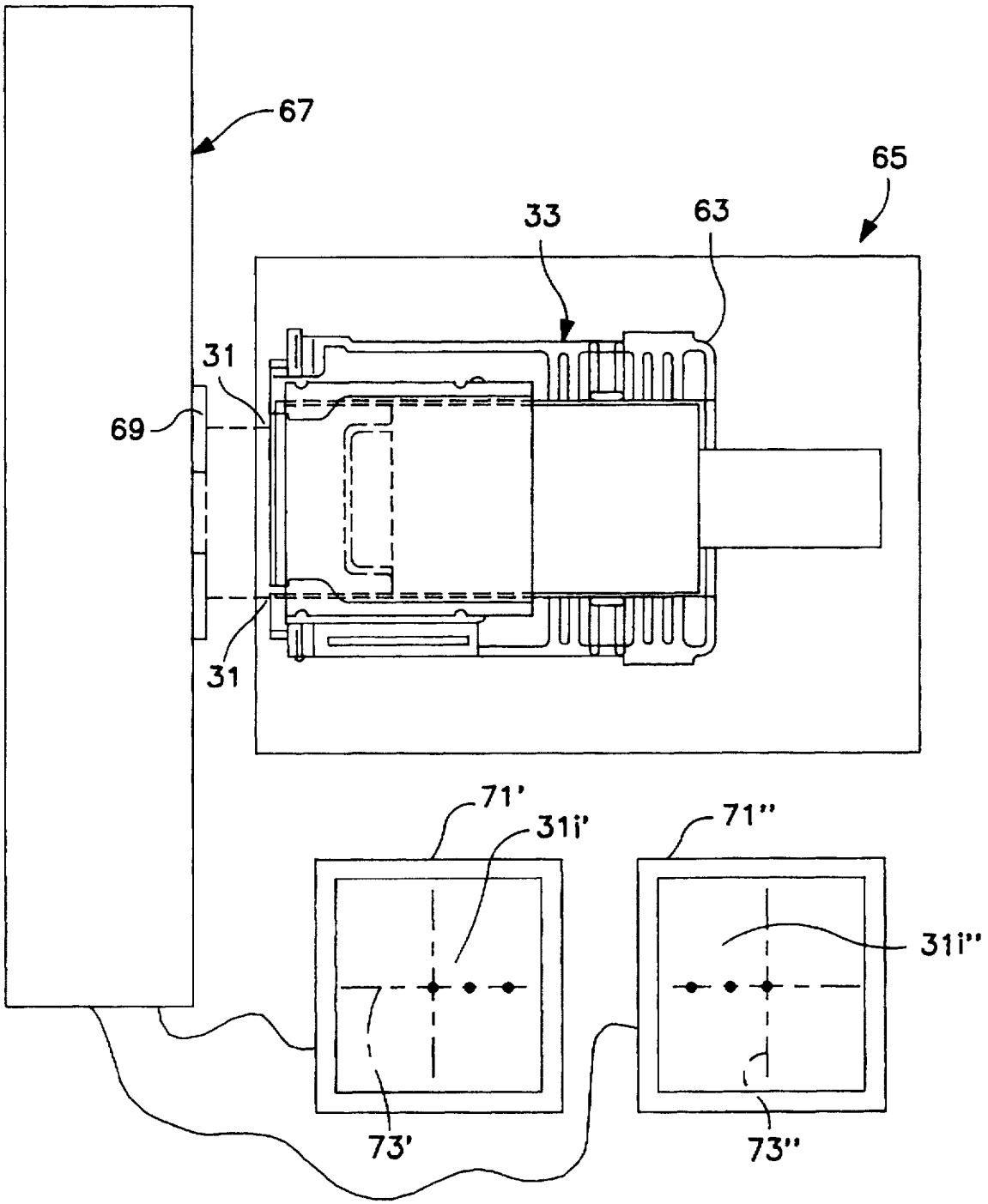
FIG. 9 is a schematic view of an optical alignment device according to an embodiment of the present invention.

Each printer head assembly 27 is preferably assembled by precisely aligning the nozzle array 29 relative to the at least three alignment points 35A, 35B, and 35C of the printer head carrier 33. To this end, as seen schematically in FIG. 9, the printer head carrier 33 is preferably positioned in a precisely formed printer head carrier receiving portion 63 of a chuck 65. The printer head carrier receiving portion 63 of the chuck 65 is pre-aligned with an optical alignment device 67. The optical alignment device 67 includes a suitable lens or camera arrangement or arrangements 69 for magnifying end portions of the nozzle array 29 and projecting images of the end portions of the nozzle array onto monitors 71' and 71". Images **31*i'*, 31*i"* corresponding to the ones 31', 31" of the nozzles 31 at opposite ends of the nozzle array 29 are aligned relative to axes 73' and 73", respectively, projected by the monitors 71' and 71" of the optical alignment device 67 to ensure proper relative alignment of the nozzle array and the head carrier 33**.

As seen in FIG. 5, the openings 39 in the plate 25 are preferably formed by first stamping the plate to stamp rough openings 39' (shown by dotted lines) having first tolerances and thereafter cutting the stamped openings to obtain cut openings having second tolerances, the second tolerances being more precise than the first tolerances. The openings 39 are preferably cut using electro-discharge machining.

As will be appreciated from FIGS. 1 and 7, force applying arrangements 45 are attached between the plate 25 and the plate 26 proximate each of the plurality of openings 39. Because the force applying arrangement preferably comprises a plurality of springs 47, the positioning of the force applying arrangement need not be excessively precise, as long as the springs apply a sufficient force against the printer head assembly 27 to cause the carrier alignment points 35A, 35B, and 35C to contact the opening alignment points 41A, 41B, and 41C. The force applying arrangements 45 preferably include protruding pins 75 for mating with corresponding holes 77 in the plate 26.

An absorbent wick 53 (FIGS. 3–4) is preferably positioned between the printer head carrier 33 and the printer head 23 such that a portion 55 of the wick is disposed proximate the nozzle array 29. A removable second portion 57 of the absorbent wick is removably positioned between the printer head carrier 33 and the printer head 23.

The plates 25 and 26 of the printer head carriage 21 preferably attached to one another by the bearing assembly 26, the spacers 30, and the carriers 48 in such a manner as to ensure that the outer surface of the plate 25 with which the nozzle arrays 29 are flush is as close to perfectly flat as possible. A preferred technique for ensuring flatness of the outer surface of the plate 25 is to assemble the foregoing components of the printer head carriage 21 on a magnetic chuck having a flat surface that holds the outer surface of the plate flat. The bearing assembly, the spacers, the carriers 48, and the rear plate 26 are mounted on the plate 25 as it is held flat by the magnetic chuck, and appropriate adjustments are made to connections between the parts such that, when the printer head carriage 21 is removed from the magnetic chuck, the plate 25 retains a flat shape. A magnetic chuck and a method for assembling parts suitable for use in making a printer head carriage are disclosed in commonly-assigned U.S. patent application Ser. No. 08/815,129 (Attorney Docket No. 031228-005), Method for Reinforcing a Flexible Sheet, which is incorporated by reference.

It is, of course, possible to embody the invention in specific forms other than those described above without departing from the spirit of the present invention. The embodiments shown are merely illustrative and should not be considered restrictive in any way. The scope of the present invention is given in the appended claims, rather than the preceding description, and all variations and equivalents which fall within the range of the claims are intended to be embraced therein.

What is claimed is:

1. A method for mounting printer heads relative to a plate, comprising the steps of:

assembling a plurality of identical printer head assemblies, each of the printer head assemblies including a printer head, the printer head including an array of a plurality of nozzles, and a printer head carrier, each of the printer head carriers having at least three alignment points;

providing openings in a plate corresponding to desired locations and orientations of the printer head assemblies on the plate, the openings each having at least three alignment points corresponding to the three alignment points on each of the printer head carriers;

positioning the printer head assemblies in corresponding ones of the openings; and applying a force against the printer head assemblies to cause the at least three alignment points on the printer head carriers to contact respective ones of the at least three alignment points in the corresponding ones of the openings.

2. The method as set forth in claim 1, wherein each printer head carrier includes an elevated reference surface, a surface of the printer head being secured to the reference surface of the printer head carrier by an adhesive.

3. The method as set forth in claim 1, wherein the step of assembling the plurality of printer head assemblies includes, for each printer head assembly, aligning the nozzle array relative to the at least three alignment points of the printer head carrier.

4. The method as set forth in claim 3, wherein the nozzle array is aligned relative to the at least three alignment points of the printer head carrier by positioning the printer head carrier in a printer head carrier receiving portion of a chuck, the printer head carrier receiving portion of the chuck being aligned with an optical alignment device, and aligning nozzles at opposite ends of the nozzle array with preset points on the optical alignment device.

5. The method as set forth in claim 4, wherein each printer head carrier includes an elevated reference surface, a surface of the printer head being secured to the reference surface of the printer head carrier by an adhesive.

6. The method as set forth in claim 5, wherein the adhesive cures when exposed to ultraviolet light, the method comprising the further step of curing the adhesive by exposing it to ultraviolet light.

7. The method as set forth in claim 1, wherein the step of providing openings in the plate includes stamping the plate to stamp openings having first tolerances and thereafter cutting the stamped openings to obtain cut openings having second tolerances, the second tolerances being more precise than the first tolerances.

8. The method as set forth in claim 7, wherein the openings are cut using electro-discharge machining.

9. The method as set forth in claim 1, comprising the further step of attaching a force applying arrangement to the plate proximate each of the plurality of openings, the force applying arrangement applying the force in the force applying step.

10. The method as set forth in claim 9, wherein the force applying arrangement includes a plurality of springs.

11. The method as set forth in claim 1, comprising the further step of positioning an absorbent wick between the printer head carrier and the printer head such that a portion of the wick is disposed proximate the nozzle array.

12. The method as set forth in claim 11, wherein the absorbent wick includes a first portion disposed proximate the nozzle array and a second portion, the second portion having a greater affinity for liquid than the first portion.

13. A mounting arrangement for a plurality of discrete printer heads on a plate, comprising:

a plurality of identical printer head assemblies, each of the printer head assemblies including a printer head, the printer head including an array of a plurality of nozzles, and a printer head carrier, each of the printer head carriers having at least three alignment points;

a plate having a plurality of openings corresponding to desired locations and orientations of the printer head assemblies, the openings each having at least three alignment points corresponding to the three alignment points on each of the printer head carriers; and a plurality of force applying arrangements, each force applying arrangement of the plurality of force applying arrangements being mounted on the plate relative to a corresponding opening of the plurality of openings and applying a force against a corresponding printer head assembly of the plurality of printer head assemblies disposed in the corresponding opening to cause the at least three alignment points on the printer head carrier of the printer head assembly to contact respective ones of the least three alignment points in the opening.

14. The arrangement as set forth in claim 13, wherein each printer head carrier includes an elevated reference surface, a surface of the printer head being secured to the reference surface of the printer head carrier by an adhesive.

15. The arrangement as set forth in claim 14, wherein the printer head carrier conducts heat better than the printer head.

16. The arrangement as set forth in claim 13, wherein the nozzle array is aligned relative to the at least three alignment points of the printer head carrier.

17. The arrangement as set forth in claim 16, wherein each printer head carrier includes an elevated reference surface, a surface of the printer head being secured to the reference surface of the printer head by an adhesive.

18. The arrangement as set forth in claim 13, wherein the force applying arrangement includes a plurality of springs.

19. The arrangement as set forth in claim 13, further comprising an absorbent wick disposed between the printer head carrier and the printer head such that a portion of the wick is disposed proximate the nozzle array.

20. The arrangement as set forth in claim 19, wherein the absorbent wick includes a first portion disposed proximate the nozzle array and a second portion, the second portion having a greater affinity for liquid than the first portion.

21. A method for mounting printer heads relative to a plate, comprising the steps of:

providing a printer head assembly of a plurality of identical printer head assemblies, each of the printer head assemblies including a printer head, the printer head including an array of a plurality of nozzles, and a printer head carrier, each of the printer head carriers having at least three alignment points;

positioning the printer head assembly in one opening of a plurality of openings in a plate corresponding to desired locations and orientations of the printer head assemblies on the plate, the openings each having at least three alignment points corresponding to the three alignment points on each of the printer head carriers; and applying a force against the printer head assemblies to cause the at least three alignment points on the printer head carriers to contact respective ones of the at least three alignment points in the corresponding ones of the openings.

* * * * *